United States Patent [19]

Beuchat et al.

[11] 4,327,625

[45] May 4, 1982

[54] DEVICE FOR TRANSMITTING SIGNALS TO A FUSE

[75] Inventors: Roger Beuchat; Pierre-Alain Charmoy; Rémy Damond, all of Vaud, Switzerland

[73] Assignee: Mefina S.A., Fribourg, Switzerland

[21] Appl. No.: 123,417

[22] Filed: Feb. 21, 1980

[30] Foreign Application Priority Data

Mar. 5, 1979 [CH] Switzerland ..... 2128793/79

[51] Int. Cl.[3] ..... F42C 17/00

[52] U.S. Cl. ..... 89/6; 102/270

[58] Field of Search ..... 102/270, 201, 209, 207; 89/6, 6.5

[56] References Cited

U.S. PATENT DOCUMENTS

| | | | |
|---|---|---|---|
| 2,465,351 | 3/1949 | Busignies et al. | 102/209 |
| 3,211,057 | 10/1965 | White, Jr. et al. | 102/209 |
| 3,228,337 | 1/1966 | Grantham et al. | 102/207 |
| 4,091,734 | 5/1978 | Redmond et al. | 102/207 |
| 4,212,246 | 7/1980 | Eaton et al. | 102/270 |
| 4,237,789 | 12/1980 | Stauers et al. | 102/270 |

*Primary Examiner*—Charles T. Jordan

*Attorney, Agent, or Firm*—Emory L. Groff, Jr.

[57] ABSTRACT

A device for transmitting signals to a fuse (1), comprising a magnetic circuit and three non-magnetic circuits. The magnetic circuit comprises a coil (5) for transmitting an energy signal which will be recovered by a coil (3) inside the fuse. The three non-magnetic circuits comprise infrared emitter receiver cells mounted on supports (12, 13, 14) outside the fuse, and on supports (6, 7, 8) inside the fuse. These cells respectively co-operate for emitting and receiving information carrying signals, which are thus separate from the energy signal.

10 Claims, 3 Drawing Figures

DEVICE FOR TRANSMITTING SIGNALS TO A FUSE

The present invention relates to a device for transmitting an energy signal and information carrying signals relative to the functioning mode and/or the firing delay of a projectile fuse, this device including an emitter part positioned outside the fuse and a receiver part positioned inside the fuse.

Devices are known in which the transfer of information is effected by magnetic induction either by means of a single magnetic circuit, the diverse signals being superposed for the transmission and filtered or separated at the receiver, all by means of different independent magnetic circuits, each for ensuring the transfer of one signal.

The object of the present invention is to provide a device, both simple and reliable, in which the information carrying signals are not, on the one hand, disturbed by the energy signal and are, on the other hand, transmitted more rapidly than in the devices described above.

According to the present invention there is provided a device for transmitting an energy signal and information carrying signals relative to the mode of operation and/or to the firing delay of a projectile fuse, this device comprising an emitter member positioned outside the fuse and a receiving member positioned inside the fuse, wherein at least one magnetic circuit ensures the transfer by magnetic induction of the energy signal and at least one non-magnetic circuit is provided for ensuring the transfer of the information carrying signals by wave propagation.

The present invention will be described further, by way of example, with reference to the accompanying drawings, in which.

Figure 1:
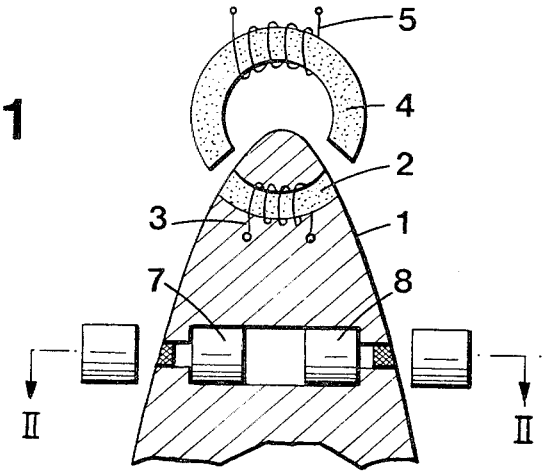
FIG. 1 is an axial section of a first embodiment.
Figure 2:
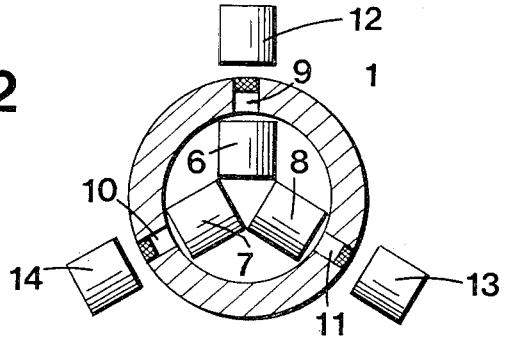
FIG. 2 is a transverse section along the line II—II of the device shown in FIG. 1.

In FIG. 1 there is shown the head of the fuse 1 inside which is disposed a magnetic core 2 carrying a winding 3 adapted to receive an energy signal by induction of a magnetic core 4 carrying a winding 5, these two last members being disposed outside the fuse 1.

Inside the fuse 1 there are disposed three supports 6, 7, 8 for cells for emitting or receiving infra-red waves. These supports 6, 7, 8 are mounted in star arrangement and in a manner so that the cells are situated opposite openings 9, 10, 11 provided in the wall of the head of the fuse 1.

Three supports 12, 13, 14 are provided outside the fuse for other infra-red wave emitter-receiver cells. These latter supports 12, 13, 14 are adapted to be placed opposite the openings 9, 10, 11 in such a manner that the cells situated respectively outside and inside the fuse can co-operate for transmitting and receiving information.

Each transmission circuit thus formed can be used for transmitting information relative to the functioning of the fuse, such as for example the duration of the delay before firing or the delay for muzzle safety.

This transfer of information can be made in series by groups of coded impulses, the codes being chosen as a function of the nature of the information. For example, BCD code can advantageously be employed to define a time interval.

Two or three cells could also be used simultaneously for a single piece of information. The value of the information transmitted could also be defined by the frequency of the signal.

It can be seen that, with respect to the information carrying signals, the transmission of the energy signal, providing the necessary energy to the fuse, is not only ensured by a different circuit but also by different propagation means.

Such an arrangement provides the advantage of being able to separate the transmissions properly, so that the energy signal will not interfere with the information carrying signals and, in the absence of such no parasitic information can be transmitted to the electronic circuit treating the information.

Moreover, since the cells can both emit and receive such signals, the information transmitted can be relayed for verification and possible modification.

The cells inside the fuse can be fed directly by the energy coil so that they only function during the time interval necessary for the transmission of energy. Thus, possibility of parasitic information getting to the electronic circuit is avoided, whilst a fairly low energy consumption is maintained.

Figure 3:
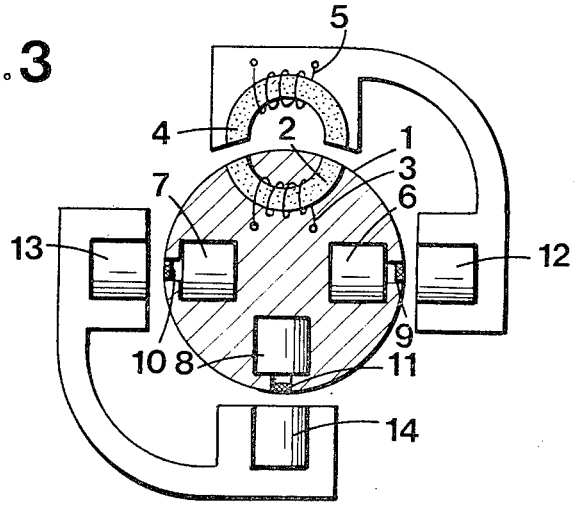
FIG. 3 is a transverse section of a second embodiment.

In FIG. 3, which shows an alternative arrangement, in which like elements are designated by like reference numbers. The different supports 6, 7, 8 inside the fuse 1 and the core 2 carrying the receiving winding 3 are disposed substantially in the same plane normal to the axis of fuse. The functioning is the same as described above.

In the two embodiments described, it is obviously necessary to provide angular positioning means on the outside part of the fuse with respect to the inside part, these means could be of any known type.

It is to be noted that such a device is advantageous from the point of view of assembly of the parts inside the fuse. It is in effect very simple to position the emitter receiver cells opposite the openings provided in the head of the fuse. The said openings can be closed by means of small transparent or translucent stoppers.

It is obvious that the infra-red waves can be replaced by other waves, whether electromagnetic or not. In practice, it has been ascertained that all waves having a wavelength between 10 Å (remote ultra-violet) and 1 mm (infra-red) are suitable to be used in the type of device described. In the case of ultra-violet it is necessary to provide, emitter cells and receiver cells not only inside but also outside the fuse if it is desired to relay the transmitted information. The device in accordance with the invention finds its application in all types of rotating and nonrotating projectiles such as mortars etc.

We claim:

1. A device for transmitting an energy signal and information carrying signals relative to a mode of operation and/or to the firing delay of a projectile fuse, said device comprising an emitter member positioned outside the fuse a receiving member positioned inside the fuse, and at least one magnetic induction circuit whereby the energy signal may be transferred by at least one magnetic induction circuit, and at least one non-magnetic circuit for permitting the transfer of information carrying signals by wave propagation.

2. A device in accordance with claim 1 including a number of non-magnetic circuits equal to the number of information carrying signals to be transmitted.

3. A device in accordance with claim 1, in which the said non-magnetic circuit is arranged for ensuring the said transfer by electromagnetic wave propagation.

4. A device in accordance with claim 3, in which the said electromagnetic waves have a wavelength of between 10 Å and 1 mm.

5. A device for transmitting an energy signal and information carrying signals relative to a mode of operation and/or to the firing delay of a projectile fuse, said device comprising an emitter member positioned outside the fuse, a receiving member positioned inside the fuse, at least one magnetic induction circuit, whereby an energy signal may be transferred by at least one magnetic induction circuit, at least one non-magnetic circuit for permitting the transfer of information carrying signals by wave propagation and a number of non-magnetic circuits equal to the number of information carrying signals to be transmitted, wherein the emitter member of the non-magnetic circuit situated outside the fuse also acts as a receiver member for information carrying signals coming from the fuse.

6. A device in accordance with claim 5, in which the emitter member comprises a wave emitter-receiver element.

7. A device in accordance with claim 6, in which the receiver member of the non-magnetic circuit situated inside the fuse also acts as an emitter member for information carrying signals.

8. A device in accordance with claim 7, in which the receiver member comprises a wave receiver-emitter element.

9. A device in accordance with claim 6 in which information transfer is ensured by infra-red wave propagation.

10. A device in accordance with claim 7 in which information transfer is ensured by ultra-violet wave propagation.

* * * * *